US010354607B2

(12) United States Patent
Park et al.

(10) Patent No.: US 10,354,607 B2
(45) Date of Patent: Jul. 16, 2019

(54) CLOCK AND SIGNAL DISTRIBUTION CIRCUITRY FOR DISPLAYS

(71) Applicant: Apple Inc., Cupertino, CA (US)

(72) Inventors: Kwang Soon Park, San Ramon, CA (US); Pei-En Chang, Campbell, CA (US); Szu-Hsien Lee, San Jose, CA (US)

(73) Assignee: Apple Inc., Cupertino, CA (US)

( * ) Notice: Subject to any disclaimer, the term of this patent is extended or adjusted under 35 U.S.C. 154(b) by 135 days.

(21) Appl. No.: 15/684,109

(22) Filed: Aug. 23, 2017

(65) Prior Publication Data

US 2018/0308445 A1 Oct. 25, 2018

Related U.S. Application Data

(60) Provisional application No. 62/487,994, filed on Apr. 20, 2017.

(51) Int. Cl.
*G09G 3/36* (2006.01)
*G09G 3/3233* (2016.01)

(52) U.S. Cl.
CPC ..... *G09G 3/3677* (2013.01); *G09G 3/3233* (2013.01); *G09G 2310/08* (2013.01); *G09G 2320/0219* (2013.01); *G09G 2320/0223* (2013.01); *G09G 2320/0233* (2013.01); *G09G 2330/02* (2013.01)

(58) Field of Classification Search
CPC ..... G09G 3/3233; G09G 3/3677; G09G 2310/08; G09G 2320/0219; G09G 2320/0223; G09G 2320/0233; G09G 2330/02
See application file for complete search history.

(56) References Cited

U.S. PATENT DOCUMENTS

| | | | | |
|---|---|---|---|---|
| 2011/0074743 | A1* | 3/2011 | Son | G09G 3/20 345/204 |
| 2013/0063404 | A1 | 3/2013 | Jamshidi Roudbari et al. | |
| 2014/0225817 | A1 | 8/2014 | Huang et al. | |
| 2015/0221275 | A1 | 8/2015 | Shin et al. | |
| 2016/0127583 | A1 | 5/2016 | Huang et al. | |
| 2016/0300546 | A1 | 10/2016 | Zheng et al. | |
| 2017/0004790 | A1 | 1/2017 | Kitsomboonloha et al. | |
| 2017/0316728 | A1* | 11/2017 | Lee | G09G 3/3266 |
| 2018/0122326 | A1* | 5/2018 | Seo | G09G 3/2092 |

* cited by examiner

*Primary Examiner* — Nelson M Rosario

(74) *Attorney, Agent, or Firm* — Treyz Law Group, P.C.; G. Victor Treyz; Joseph F. Guihan

(57) ABSTRACT

A display may have an array of pixels. Rows of pixels may receive gate line signals over gate lines. Display driver circuitry may have an adjustable clock generator that generates a series of clock pulses with different respective fall times to help equalize kickback voltages in the pixels of different rows. Within each row, gate lines may be provided with multiple parallel lines shorted at a series of tap points to help equalize kickback voltages across the pixels of different columns. A clock path may be formed between the clock generator and gate driver circuits. The clock path may run along an edge of the array of pixels. To help equalize kickback voltages in the pixels of different rows, the clock path may have first and second parallel metal lines that are selectively shorted to each other at a series of tap point locations along the clock path.

20 Claims, 13 Drawing Sheets

CLOCK AND SIGNAL DISTRIBUTION CIRCUITRY FOR DISPLAYS

This application claims the benefit of provisional patent application No. 62/487,994, filed on Apr. 20, 2017, which is hereby incorporated by reference herein in its entirety.

BACKGROUND

This relates generally to electronic devices, and, more particularly, to electronic devices with displays.

Electronic devices such as cellular telephones, computers, and other electronic devices often contain displays. A display includes an array of pixels for displaying images to a user. Display driver circuitry such as data line driver circuitry may supply data signals to the array of pixels. Gate line driver circuitry in the display driver circuitry can be used to assert a gate line signal on each row of pixels in the display in sequence to load data into the pixels.

It can be challenging to uniformly control the pixels in the array of pixels using the display driver circuitry. Unless care is taken, the light output level for the pixels in different portions of the display may vary.

SUMMARY

A display may have an array of pixels controlled by display driver circuitry. The display driver circuitry may supply the pixels with data signals over data lines in columns of the pixels and may supply the pixels with gate line signals over gate lines in rows of the pixels. Gate driver circuitry in the display driver circuitry may be used in supplying the gate lines signals.

The gate driver circuitry may have gate driver circuits each of which supplies a respective one of the gate lines signals to the pixels in a respective row of the array of pixels. The display driver circuitry may have an adjustable clock generator that generates a series of clock pulses characterized by different respective fall times to help equalize kickback voltages in the pixels of different rows.

Within each row, gate lines may be provided with multiple parallel lines shorted at a series of tap points to help equalize kickback voltages across the pixels of different columns.

A clock path may be formed between the clock generator and the gate driver circuits. The clock path may run along an edge of the array of pixels. To help equalize kickback voltages in the pixels of different rows, the clock path may have first and second parallel metal lines that are selectively shorted to each other at a series of tap point locations along the clock path.

DETAILED DESCRIPTION

Figure 1:
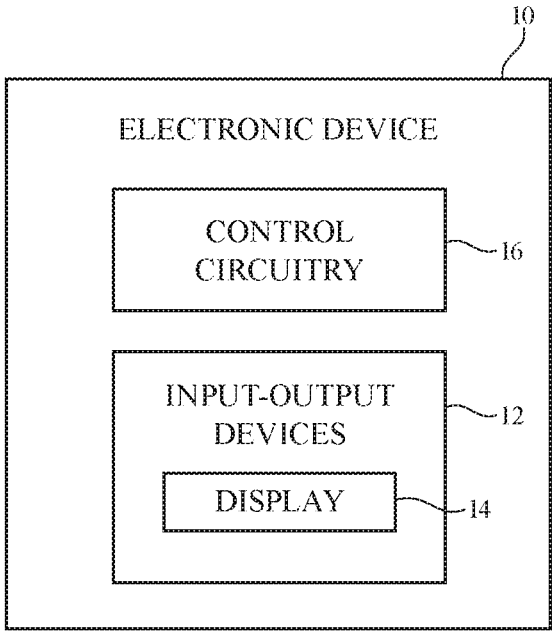
FIG. 1 is a schematic diagram of an illustrative electronic device having a display in accordance with an embodiment.

An illustrative electronic device of the type that may be provided with a display is shown in FIG. 1. Electronic device 10 of FIG. 1 may be a tablet computer, laptop computer, a desktop computer, a monitor that includes an embedded computer, a monitor that does not include an embedded computer, a display for use with a computer or other equipment that is external to the display, a cellular telephone, a media player, a wristwatch device or other wearable electronic equipment, or other suitable electronic device.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14.

Display 14 may be an organic light-emitting diode display, a liquid crystal display, an electrophoretic display, an electrowetting display, a display based on an array of discrete crystalline light-emitting diode dies, or a display based on other types of display technology. Configurations in which display 14 is a liquid crystal display may sometimes be described herein as an example.

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
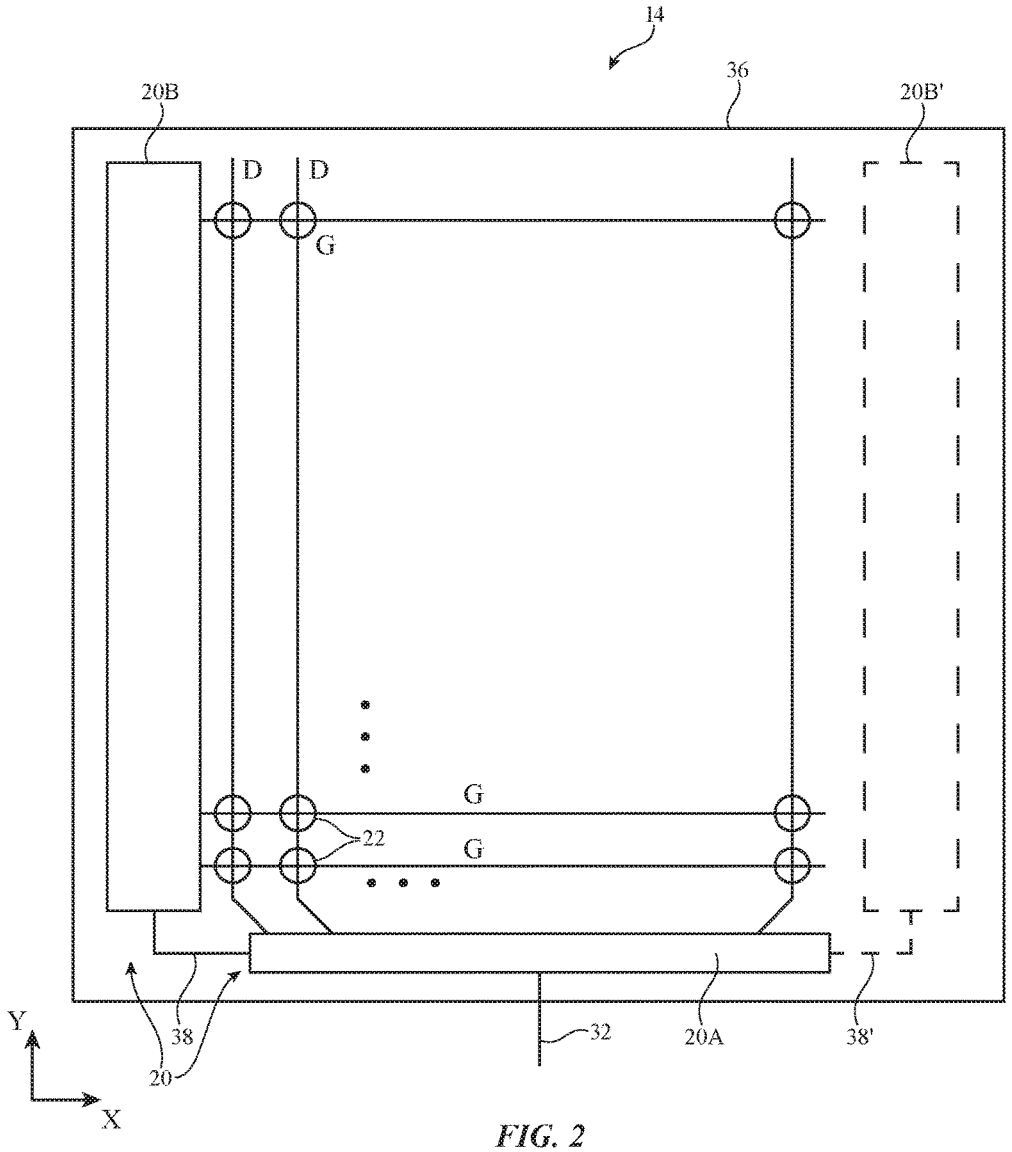
FIG. 2 is a top view of an illustrative display in an electronic device in accordance with an embodiment.

A top view of a portion of display 14 is shown in FIG. 2. As shown in FIG. 2, display 14 may have an array of pixels 22 formed from substrate structures such as substrate 36. Substrates such as substrate 36 may be formed from glass, metal, plastic, ceramic, or other substrate materials. Pixels 22 may receive data signals over signal paths such as data lines D and may receive one or more control signals over control signal paths such as horizontal control lines G (sometimes referred to as gate lines, scan lines, emission control lines, gate signal paths, etc.). There may be any suitable number of rows and columns of pixels 22 in display 14 (e.g., tens or more, hundreds or more, or thousands or more). In organic light-emitting diode displays, pixels 22 contain respective light-emitting diodes and pixel circuits that control the application of current to the light-emitting diodes. In liquid crystal displays, pixels 22 contain pixel circuits that control the application of signals to pixel electrodes that are used for applying controlled amounts of electric field to pixel-sized portions of a liquid crystal layer. The pixel circuits in pixels 22 may contain transistors having gates that are controlled by gate line signals on gate lines G.

Display driver circuitry 20 may be used to control the operation of pixels 22. Display driver circuitry 20 may be formed from integrated circuits, thin-film transistor circuits, or other suitable circuitry. Thin-film transistor circuitry may be formed from polysilicon thin-film transistors, semiconducting-oxide thin-film transistors such as indium gallium zinc oxide transistors, or thin-film transistors formed from other semiconductors. Pixels 22 may have color filter elements or other colored structures of different colors (e.g., red, green, and blue) to provide display 14 with the ability to display color images.

Display driver circuitry 20 may include display driver circuits such as display driver circuit 20A and gate driver circuitry 20B. Display driver circuit 20A may be formed from one or more display driver integrated circuits and/or thin-film transistor circuitry (e.g., timing controller integrated circuits). Gate driver circuitry 20B may be formed from gate driver integrated circuits or may be thin-film "gate-on-array" circuitry. Display driver circuit 20A of FIG. 2 may contain communications circuitry for communicating with system control circuitry such as control circuitry 16 of FIG. 1 over path 32. Path 32 may be formed from traces on a flexible printed circuit or other conductive lines. During operation, the control circuitry (e.g., control circuitry 16 of FIG. 1) may supply circuit 20A with information on images to be displayed on display 14.

To display images on display pixels 22, display driver circuitry 20A may supply image data to data lines D while issuing control signals to supporting display driver circuitry such as gate driver circuitry 20B over path 38. Path 38 may, for example, include lines for carrying power signals such as a gate high voltage signal Vgh (which can serve as a maximum gate line signal value output from the gate driver circuitry onto each gate line) and a gate low voltage signal Vg1 (which can serve as a ground), control signals such as gate output enable signals, clock signals, etc. Circuitry 20A may supply these signals to gate driver circuitry 20B on one or both edges of display 14 (see, e.g., path 38' and gate driver circuitry 20B' on the right-hand side of display 14 in the example of FIG. 2).

Gate driver circuitry 20B (sometimes referred to as horizontal control line control circuitry) may control horizontal control lines (gate lines) G using the signals received from path 38 (e.g., using the gate high voltage, gate low voltage, gate output enable signals, gate clock signals, etc.). Gate lines G in display 14 may each carry a gate line signal for controlling the pixels 22 of a respective row (e.g., to turn on transistors in pixels 22 when loading data from the data lines into storage capacitors in those pixels from data lines D). During operation, frames of image data may be displayed by asserting a gate signal on each gate line G in the display in sequence. Shift register circuitry (e.g., a chain of gate driver circuits formed from registers and associated output buffers) in gate driver circuitry 20B may be used in controlling the gate line signals.

Figure 3:
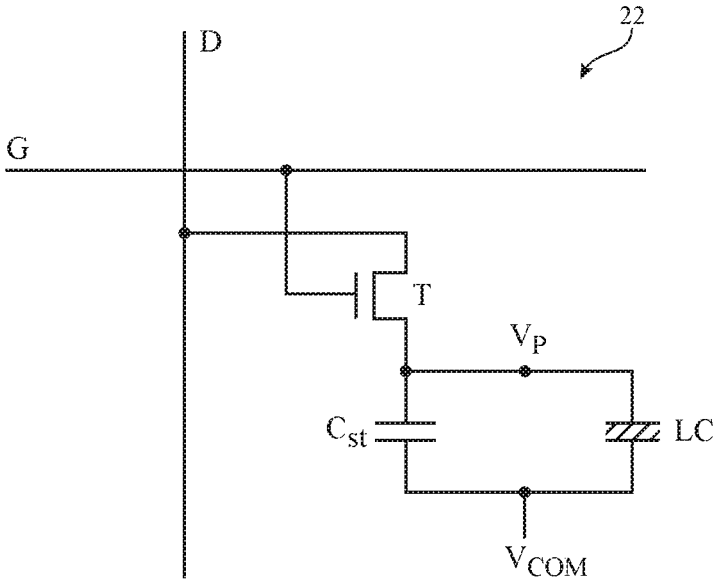
FIG. 3 is a circuit diagram of an illustrative pixel circuit in a display in accordance with an embodiment.

An illustrative pixel circuit for pixels 22 of display 14 is shown in FIG. 3. As shown in FIG. 3, each pixel 22 may include a pixel-sized portion of a liquid crystal layer LC to which electric fields may be supplied using corresponding pixel electrodes. The magnitude of the applied field is proportional to pixel voltage Vp minus common electrode voltage Vcom. During data loading operations, a desired data line signal (i.e., a data voltage Vp that is to be loaded into pixel 22) is driven onto data line D. The gate line signal on gate line G is asserted while the data line signal on data line D is valid. When the gate line signal is asserted, the gate of transistor T is taken high and transistor T is turned on. With transistor T turned on, data from line D is driven onto storage capacitor Cst and establishes pixel voltage Vp. Storage capacitor Cst maintains the value of Vp between successive image frames.

Figure 4:
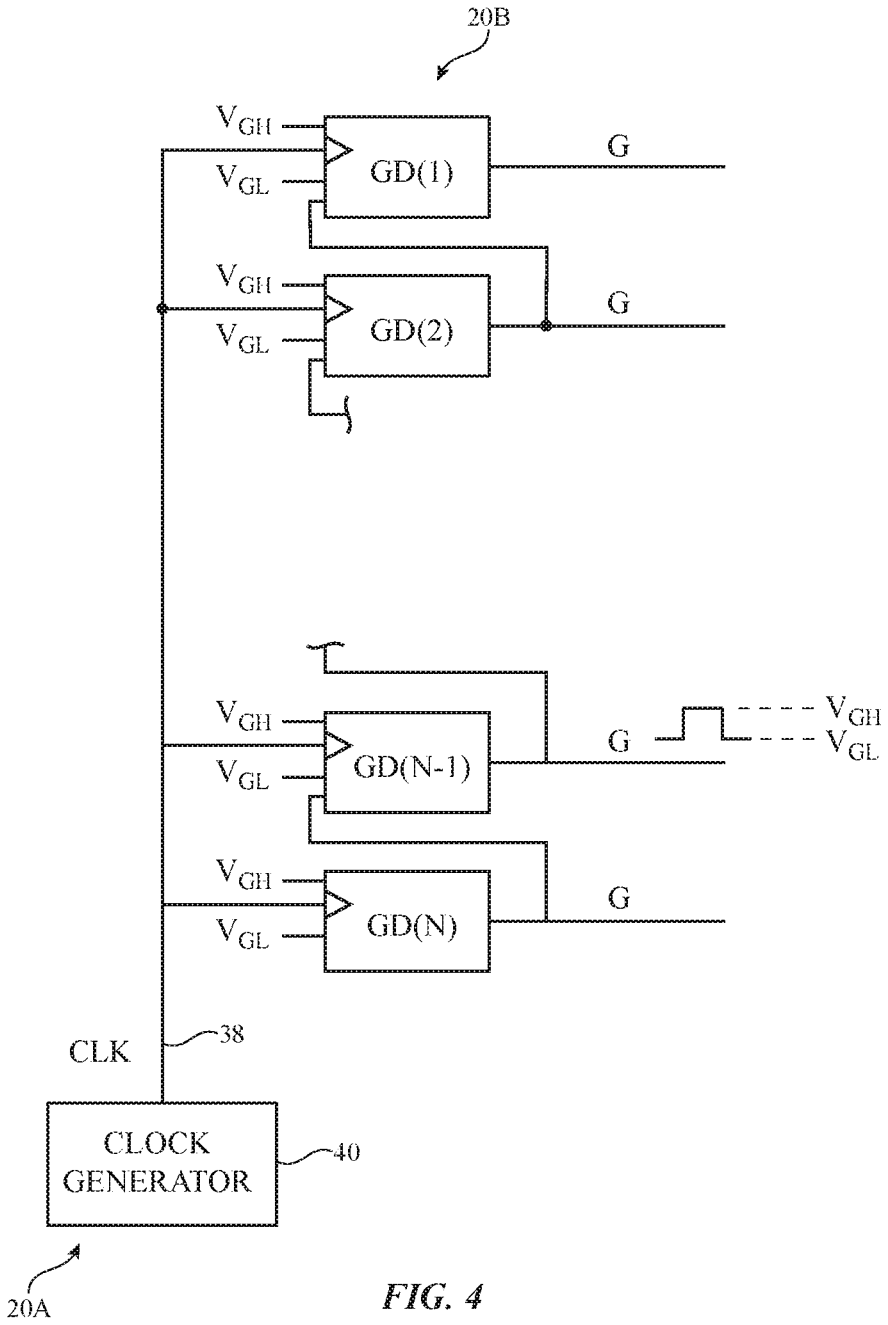
FIG. 4 is diagram of illustrative gate driver circuitry in accordance with an embodiment.

FIG. 4 is a diagram of illustrative gate driver circuitry 20B. As shown in FIG. 4, gate driver circuitry 20B may contain multiple gate driver circuits (gate line driver circuits) GD(1), GD(2) . . . GD(N). Each gate driver circuit has a register circuit coupled to an output buffer (gate line buffer) that strengthens gate line signals as they are driven onto gate lines G. The register circuits are coupled in series, so that the output of each register (see, e.g., each gate line signal being provided to a gate line G of FIG. 4) serves as the trigger input to a subsequent register circuit in the shift register. The gate line signals provided to gate lines G by circuitry 20B may be asserted in sequence so that data can be loaded into each of the rows of pixels 22 in display 14.

Gate driver circuitry 20B may use a single phase or multiphase clock arrangement. As shown in FIG. 4, signals such as gate clock signals (see, e.g., clock signal CLK in FIG. 4) may be provided to gate driver circuits GD(1), GD(2) . . . GD(N) using signal lines such as path 38. Clock generator 40 (e.g., clock generator circuitry in display driver circuitry 20A) may generate gate driver circuit clock signals such as signal CLK. Each gate driver circuit in circuitry 20A may also receive a power supply signals such as gate high voltage Vgh and a gate low voltage Vg1, which are used in generating gate lines signals. Signal paths such as path 38 may be routed vertically alongside the gate driver integrated circuits on substrate 36 (e.g., along dimension Y of FIG. 2 at the edge of the array of pixels 22 in display 14) and may include horizontal line portions (e.g., clock distribution lines extending in dimension X of FIG. 2).

Figure 5:
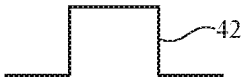
FIG. 5 is a diagram of an illustrative gate clock pulse in accordance with an embodiment.
Figure 6:
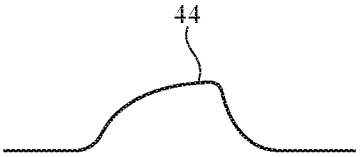
FIG. 6 is a diagram of an illustrative gate clock pulse after propagation through a clock signal path in accordance with an embodiment.

There is a parasitic gate-source capacitance Cgs between the gate and source of transistor T of each pixel 22 (FIG. 3). The presence of capacitance Cgs gives rise to a kickback voltage Vkb that can lead to fluctuations in pixel voltage Vp as Vp is being maintained on pixel 22 between frames. The kickback voltage is proportional to (Cgs/Cst)*(ΔVg)*(1/tf), where tf is the fall time of the gate line signal applied to transistor T and ΔVg is equal to Vgh−Vg1 (the magnitude of the gate line signal). If care is not taken, variations in signals such as the clock signal CLK (e.g., clock fall time variations due to capacitive and resistive loading on gate clock signal distribution paths) can lead to variations in the fall times of the clock signals at the inputs of the gate driver circuits and therefore can lead to variations in the fall times of the gate line signals. Variations in the fall times of the gate line signals can cause the magnitude of kickback voltage Vkb to vary across display 14. If Vkb is different at different gate line locations in display 14, pixel voltage Vp will vary for pixels 22 in different display locations. This can lead to undesired display brightness variations across the surface of display 14. If, for example, signal loading on a gate clock line in path 38 causes a clock signal that is output from generator 40 as signal 42 of FIG. 5 to degrade into a signal with longer rise and fall times such as signal 44 of FIG. 6 in proportion to the distance the signal is carried on the gate clock line, different pixels will receive different corresponding gate line signals. Pixels that receive gate line signals with the undegraded shape of signal 42 will exhibit more kickback voltage than pixels that receive signals with the shape of signal 44.

Figure 7A:
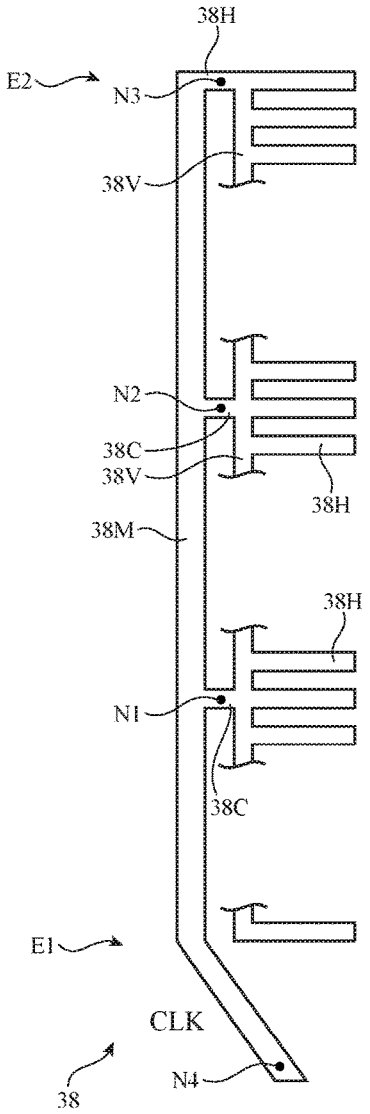
FIG. 7A is a top view of an illustrative gate clock signal path in accordance with an embodiment.

FIG. 7A shows how the metal traces used in forming a gate clock distribution path that is configured to reduce gate clock fall time differences and therefore kickback voltage differences across display 14. As shown in FIG. 7A, path 38 may serve as a gate clock path for carrying gate clock signal CLK. Gate clock path 38 may have a main vertical line such as line 38M and a parallel vertical line such as line 38C running vertically along an edge of display 14 parallel to gate driver circuitry 20B. Horizontal clock signal lines such as lines 38H may each have one end that is shorted to a respective vertical location on line 38V and an opposing end that is coupled to the gate clock input of a respective gate driver circuit GD(i) of FIG. 4. Path 38 extends vertically between first end E1 at node N4 (e.g., adjacent to clock generator 40) and second end E2. Horizontal coupling paths (lines) 38C are formed between line 38M and line 38V at various different locations along the length of path 38. Paths 38C serve tap points (tap point paths) at which line 38V receives clock signal CLK from path 38M. In the example of FIG. 7A, there are three tap point paths 38C at nodes N1, N2, and N3. Other numbers of tap points (e.g., at least two tap points, at least four tap points, fewer than five tap points, etc.) may be used in selectively shorting line 38V to line 38M along the length of path 38, if desired.

Figure 7B:
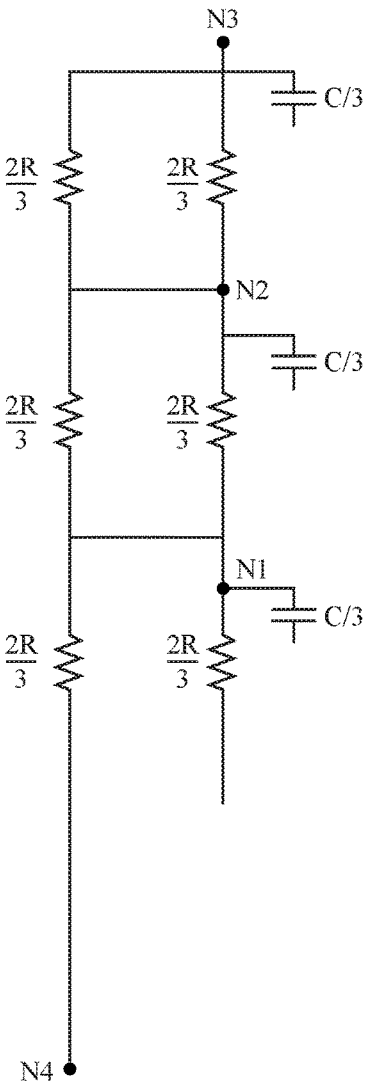
FIG. 7B is an equivalent circuit of the gate clock signal path of FIG. 7A.

FIG. 7B is an equivalent circuit of path 38 of FIG. 7B, in which resistance R is the line resistance associated with the entire length of path 38 and in which capacitance C is the loading capacitance for path 38. In the absence of distributed tap point paths 38C (e.g., if lines 38M and 38V were shorted along their entire lengths), the fall time of the clock signal CLK at end E1 of path 38 would be short (Vkb for the pixels 22 on the gate lines close to E1 would be high) and the fall time of the clock signal CLK at end E2 of path 38 would be long (Vkb for the pixels on the gate lines close to E2 would be low). With the distributed tap point architecture of FIGS. 7A and 7B, however, all clock signals will have a substantially similar fall time tf (e.g., signals near E1 will have an increased fall time that matches the fall time of signals near E2), so Vkb will be equalized across display 14 and output brightness variations in the pixels 22 across display 14 will be reduced.

Figure 8:
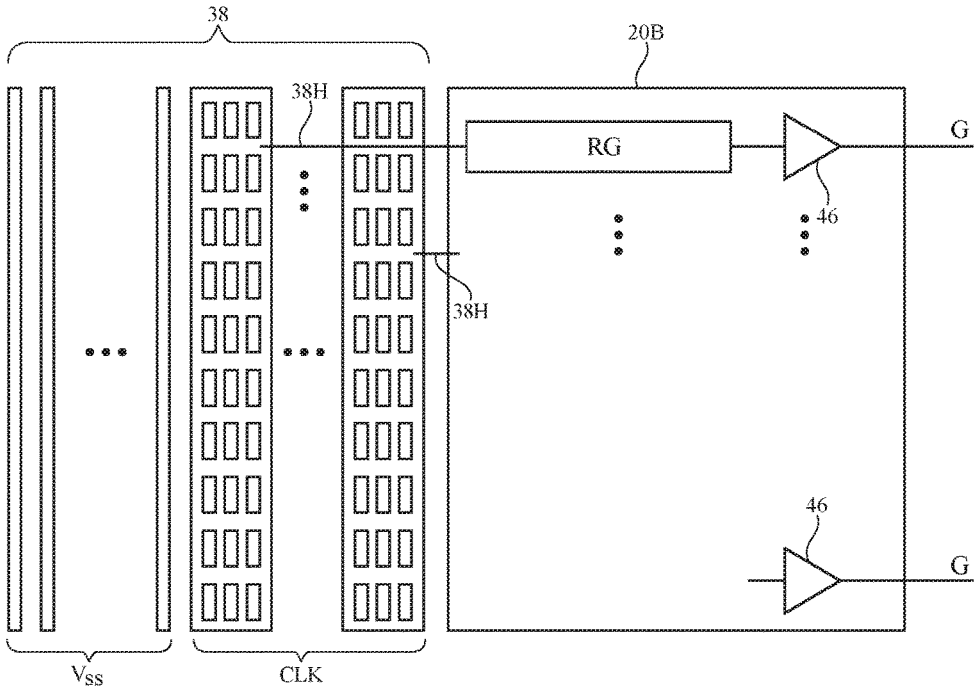
FIG. 8 is a diagram of illustrative metal traces of the type that may be used in distributing gate clock signals in accordance with an embodiment.

FIG. 8 is an illustrative layout for circuitry 20B and path 38. Path 38 may include power supply paths such as illustrative ground paths Vss and may include multiple strips of metal traces forming respective clock distribution lines for clock signals CLK (see, e.g., lines 38M and 38V of FIG. 7A). The clock paths may be formed from mesh-shaped (grid-shaped) metal traces. Openings in these metal traces may help reduce capacitive loading on signal lines that horizontally cross the clock paths. Horizontal clock lines 38H may be used to provide clocks signals CLK to respective inputs of registers RG. Each register RG may be associated with a respective gate driver circuit and may supply an output signal to a respective gate driver circuit output buffer 46 in that gate driver circuit. The output from buffer 46 in each gate driver circuit forms a respective gate line signal on a corresponding gate line G.

Figure 9:
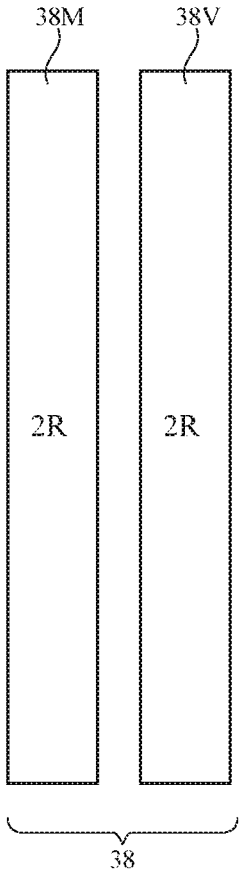
FIG. 9 is a diagram showing how parallel single-layer metal traces of resistance 2R may be used in distributing clock signals in accordance with an embodiment.
Figure 10:
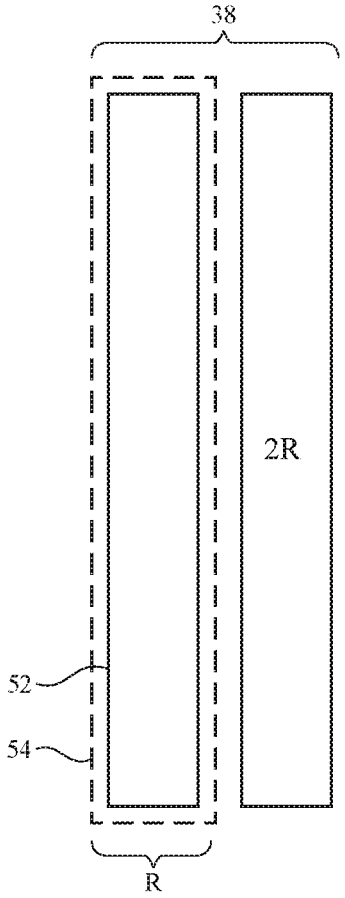
FIG. 10 is a diagram showing how parallel metal traces of respective resistances R (formed from double metal layers) and 2R may be used in distributing clock signals in accordance with an embodiment.

FIG. 9 shows how a clock distribution path of resistance R may be formed by a line 38M of resistance 2R and a parallel line 38V of resistance 2R. If desired, one of these lines may be formed from first metal trace layer 54 and an overlapping and electrically coupled second metal trace layer 56 as shown in FIG. 10, thereby reducing the resistance of that line to R. Traces 54 and 56 may be electrically coupled using vias, using elongated openings in an intervening dielectric layer, and/or using other shorting paths. Arrangements of the type shown in FIG. 10 may reduce gate clock path resistance and may be used to reduce clock delays while equalizing kickback voltages across display 14.

Figure 11:
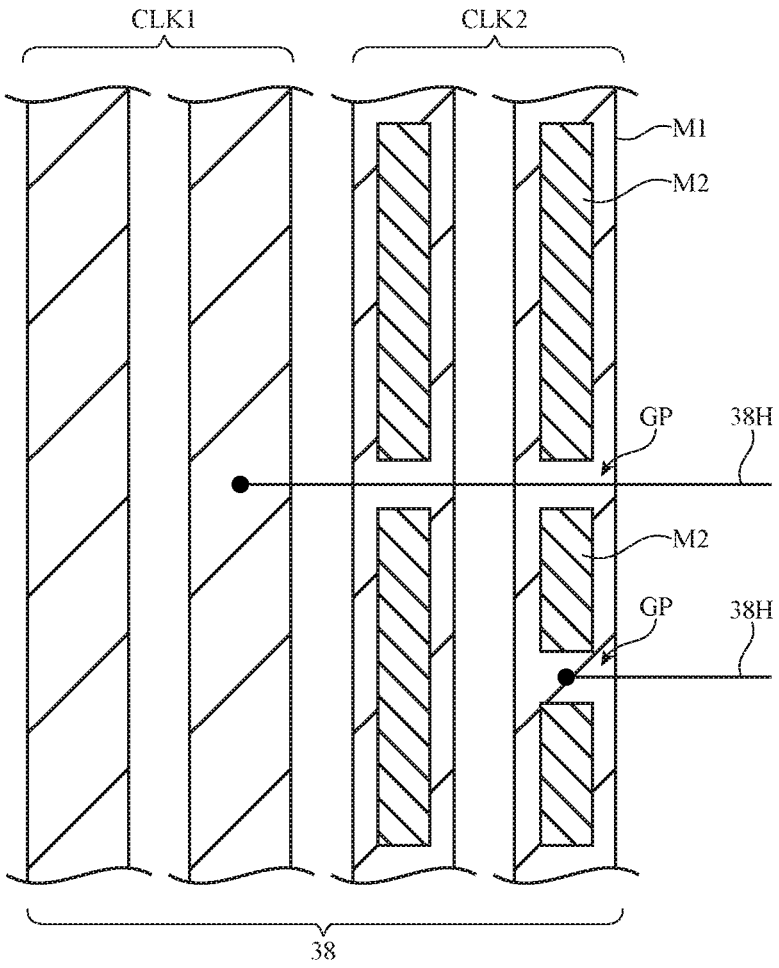
FIG. 11 is a diagram of illustrative metal traces that include traces in a first metal layer for distributing gate clock signals while allowing horizontal gate clock signal lines to extend through openings in a second layer of metal in accordance with an embodiment.

Path 38 may carry multiple clock signals such as clock signals CLK1 and CLK2 of FIG. 11. As shown in FIG. 11, portions of paths 38 may include a second layer of metal traces (e.g., traces in metal layer M2) that overlap a first layer of metal traces (e.g., traces in metal layer M1). Gaps GP may be formed in metal traces M2 to allow horizontal clock lines 38H to pass horizontally to gate driver circuitry 20B. Metal traces M2 may be shorted to overlapped portions of traces M1 along their lengths (e.g., using vias) to help reduce signal line resistance and therefore reduce clock delays, as described in connection with overlapping metal traces 52 and 54 of FIG. 10.

Figure 12:
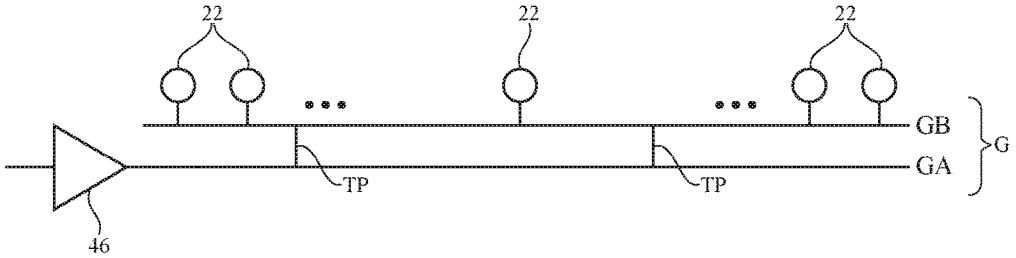
FIG. 12 is a circuit diagram of an illustrative gate line formed from multiple parallel metal lines shorted together at a series of tap points in accordance with an embodiment.

Horizontal signal lines such a gate lines G can introduce signal delays. For example, the resistance and capacitance of lines G may introduce progressively increasing amounts of delay (increases in fall time) at corresponding increasing distances across display 14 from output buffer 46. To help equalize these signal delays and thereby help reduce kick-back voltage variations across display 14, gate lines G may each be formed from multiple parallel paths such as metal lines GA and GB of FIG. 12 that are coupled along their lengths using signal paths (shorting paths) at various tap points TP. The signal paths associated with tap points TP may be formed from vias and/or other metal traces on display 14. There may be at least two tap points TP at two corresponding horizontal locations along the length of each gate line G, at least three tap points TP at three different locations along the gate line G, or at least four tap points TP at different locations along the gate line (as examples). The locations of tap points TP in each row may be selected to help equalize gate line signal fall time lengthening as gate line signals are distributed over the gate line in that row to the pixels in that row.

Figure 13:
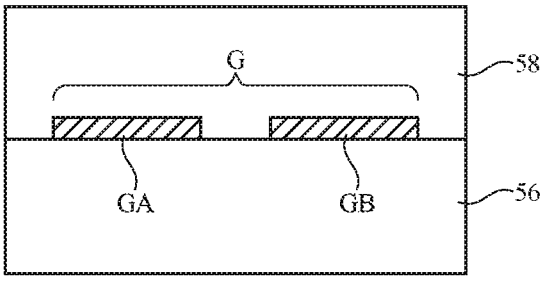
FIGS. 13 and 14 are cross-sectional side views of illustrative gate lines formed from multiple metal traces in accordance with embodiments.
Figure 14:
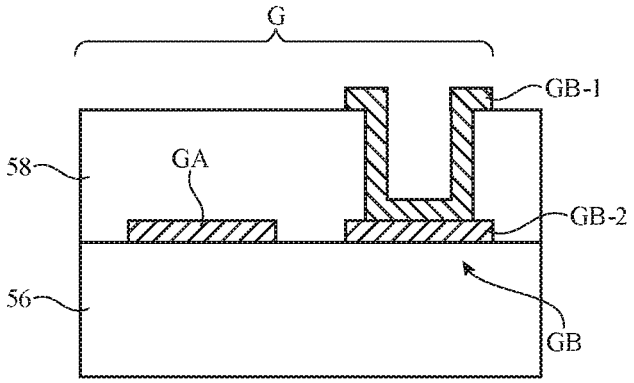

FIG. 13 is a cross-sectional side view of a portion for display 14 showing how metal lines GA and GB for each gate line G may be formed from a single patterned layer of metal on underlying layers such as layer 56 that is covered with dielectric 58. Lines GA and GB may be formed from other patterns of metal traces, if desired. As shown in FIG. 14, for example, line GB may be formed from patterned metal traces in multiple metal layers such as line GB-1 in a first metal layer and line GB-2 in a second metal layer. Lines GB-1 and GB-2 may shorted along their lengths (e.g., GB-1 may be formed from segments of metal that are shorted to GB-2 using vias or other openings through dielectric 58) to reduce the resistance of metal line GB. Tap point signal paths may be formed at desired locations along the lengths of GA and GB to form a gate line such as gate line G of FIG. 12 (e.g., using at least two tap point signal paths along each gate line, at least three tap point signal paths along each gate line, using fewer than five tap point signal paths along each gate line, or using other suitable sets of tap points).

Figure 15:
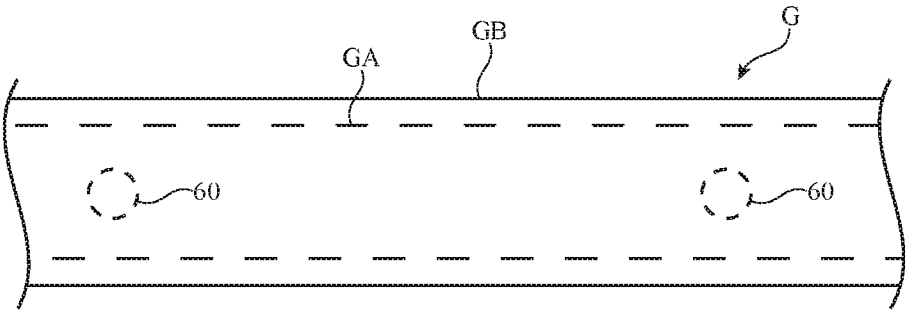
FIG. 15 is a top view of an illustrative gate line with multiple layers of metal traces and tap point paths formed from metal vias in accordance with an embodiment.

FIG. 15 is a top view of an illustrative portion of a gate line G showing how gate line G may be formed by a first line in a first metal layer (line GA) and a second line in a second overlapping metal layer (line GB) that are shorted at various tap point locations their lengths using vias 60 (e.g., tap point vias). There may be, for example, at least two tap point vias 60 along the length of gate line G, at least three tap point vias 60 for each gate line G, fewer than five tap point vias 60, etc. By selectively coupling first and second parallel gate line portions to form each gate line G, the loading imposed on gate line signals G (e.g., capacitive and resistive loading that increases the fall time of gate line signal G) can be equalized for pixels 22 distributed in a row of display 14 along dimension X (FIG. 2). Variations in clock signal delay in the Y dimension can be equalized using clock paths with parallel lines (e.g., 38M and 38V) that are coupled together using a set of tap point connections. If desired, both Y-dimension kickback voltage variations (due to Y-position-dependent changes in the fall time of CLK and therefore gate line signals G) and X-dimension kickback voltage variations (due to X-position-dependent changes in the fall time of gate lines signals G) can be minimized by using gate line arrangements of the type shown by gate line G of FIG. 12 and using clock signal paths of the type shown in FIG. 7A.

Figure 16:
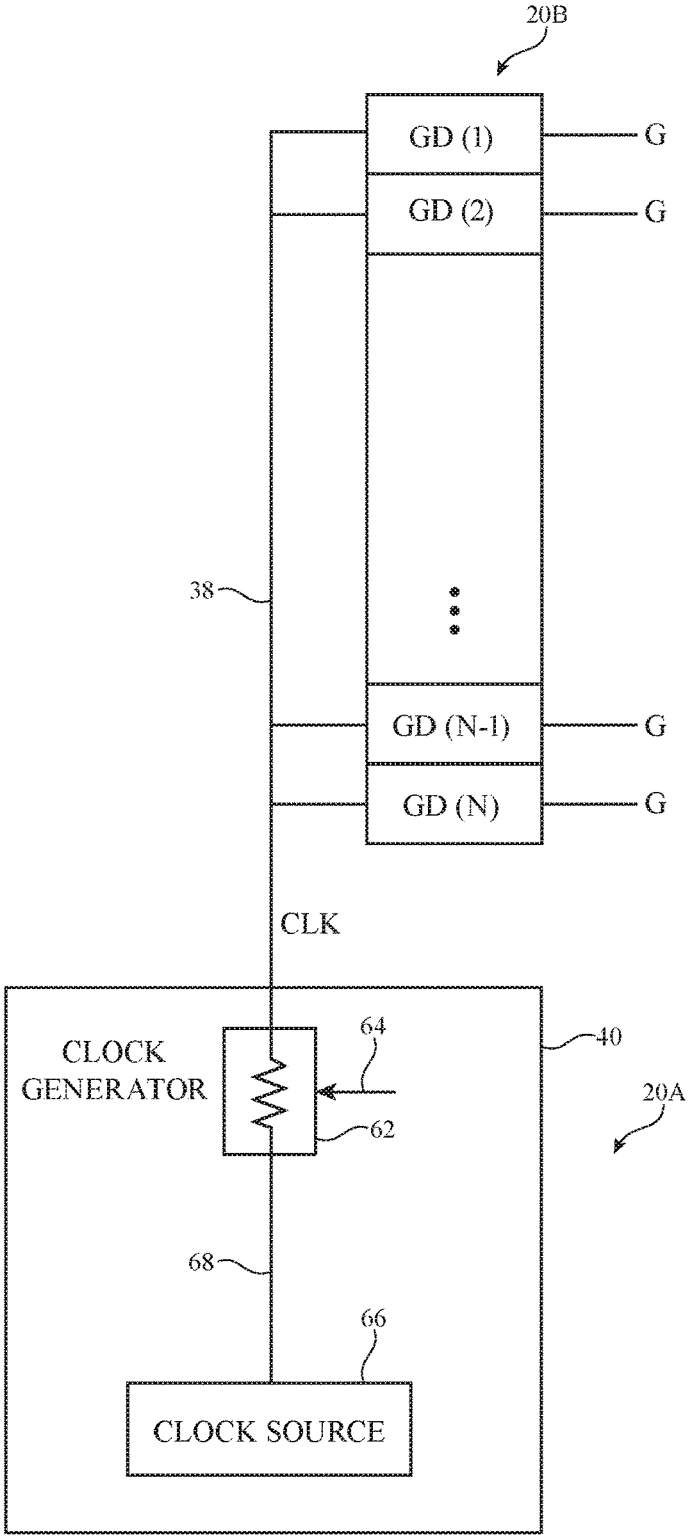
FIG. 16 is a circuit diagram of illustrative clock generation circuitry and gate driver circuitry in accordance with an embodiment.

FIG. 16 is a circuit diagram of illustrative display driver circuitry that may be used in helping to equalize kickback voltage variations across display 14. This display driver circuitry includes an adjustable clock generator and may, if desired, be used in connection with single-line clock distribution paths, clock distribution paths having multiple parallel lines coupled selectively by tap points, and/or gate lines with multiple parallel metal lines coupled selectively by tap points.

As shown in FIG. 16, display driver circuitry 20A may include adjustable clock generator circuitry such as adjustable clock generator 40. Adjustable clock generator 40 may generate clock signals with time-varying fall times (e.g., fall times that increase from pulse to pulse as these clock pulses are being provided to the gate driver circuits for each of the rows of pixels in display 14). Adjustable clock generator 40 may have signal generator circuit such as clock source 66 that generates clock pulses (e.g., square clock pulses) on output path 68. An adjustable locating circuit such as adjustable resistor circuitry 62 (e.g., an adjustable resistance circuit formed from one or more transistors and/or other circuitry) may have a control input such as input 64 that receives control signals from control circuitry in device 10 (e.g., control circuitry in display driver circuitry 20A and/or other control circuitry 16 in device 10). The control signals that are supplied to input 64 may direct adjustable resistor circuit 62 to adjust the amount of signal loading (e.g., the resistance) imposed on the clock pulses on path 68. This allows the fall times of the clock pulses that are supplied to path 38 to be varied as a function of time, as illustrated by clock (CLK) signals 70, 72 and 74 of FIG. 17.

Figure 17:
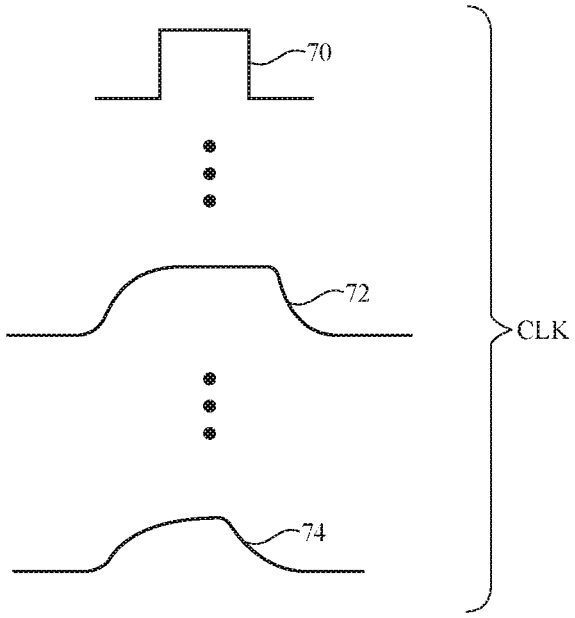
FIG. 17 is a diagram of illustrative clock signals of the type that may be produced by a dynamically adjustable clock generator in accordance with an embodiment.

In the example of FIG. 17, clock generator 40 produces clock pulse 70 at a first time, produces clock pulse 72 at a second time that is later than the first time, and produces clock pulse 74 at a third time that is later than the second time. Clock pulse 70 is received by gate driver circuit GD(1) and is used by gate driver circuit GD(1) in producing an associated gate signal for gate line G in the first row of pixels 22 in display 14. Clock pulse 72 is timed to be received by a gate driver circuit at an intermediate location along gate driver circuitry 20A (e.g., a gate driver circuit associated with one of the middle rows of pixels 22 in display 14). Clock pulse 74 is used by gate driver GD(N) at the lower edge of display 14 to produce a gate line signal on gate line G in the last row of pixels 22 in display 14.

As this example demonstrates, clock generator 40 may be adjusted dynamically using control signals at input 64 so that clock signals destined for gate driver circuits near the top of display 14 that will travel over longer portions of path 38 are supplied to path 38 from the output of clock generator 40 with shorter fall times than clock signals destined for gate driver circuits near the bottom of display 14 that will travel over shorter portions of path 38. In this way, the signals that travel farther along path 38 start with short fall times and end having long fall times, whereas the signals that travel shorter distances along path 38 will start and end with long fall times. This equalizes clock fall times across different rows of display 14.

Consider, for example, a signal being generated with clock generator 40 for use by gate driver circuit GD(N). This signal will pass through a short length of path 38 and will therefore be subjected to relatively small amounts of signal loading by path 38. In contrast, a single being generated with clock generator 40 for use by gate driver circuit GD(1) will be subjected to relatively large amounts of signal loading by path 38. To ensure that the clock signals received by gate driver circuits GD(1) and GD(N) have substantially equal amounts of delay (e.g., equal fall times), clock generator 40 may generate the clock pulse destined for gate driver circuit GD(N) using a high setting for variable resistor 62 to ensure that the fall time for this pulse is high as the pulse is output onto path 38, whereas clock generator 40 may generate the clock pulse destined for gate driver circuit GD(1) using a low setting for variable resistor 62 to ensure that the fall time for this pulse is low when output onto path 38 and is long after traveling the entire length of path 38.

Techniques such as these for using an adjustable clock generator to equalize the fall time of the clock pulses received by the gate driver circuits in each row of display 14 by varying the fall times of the clock pulses between clock pulses may, if desired, be used in conjunction with signal line arrangements that help equalize kickback voltages (e.g., gate line trace patterns that have multiple parallel gate line portions selectively coupled along their lengths at tap point locations and/or clock path trace patterns for helping to equalize clock fall times) or may be used with other gate lines and clock paths.

The foregoing is merely illustrative and various modifications can be made to the described embodiments. The foregoing embodiments may be implemented individually or in any combination.

What is claimed is:

1. A display, comprising:

an array of pixels having rows and columns;

display driver circuitry that provides data signals to columns of the pixels over data lines, wherein the display driver circuitry includes gate driver circuitry that runs along at least one edge of the array of pixels and that has gate driver circuits that each provide a gate line signal to a respective row of the pixels over a respective gate line;

a clock generator configured to generate clock signals; and a clock path that conveys the clock signals to each of the gate driver circuits from the clock generator, wherein the clock path has a first clock line that extends along the edge of the array of pixels, has a second clock line that extends along the edge of the array of pixels, and has a plurality of tap point paths each of which shorts the first clock line to the second clock line at a different respective location along the signal path to equalize clock pulse fall times in the clock signals at the gate driver circuits.

2. The display defined in claim 1 wherein each gate line has a first gate line portion and a second gate line portion shorted to each other by a plurality of different shorting paths at a plurality of different locations along that gate line.

3. The display defined in claim 2 wherein there are fewer than five tap point paths shorting the first clock line to the second clock line and wherein there are fewer than five different locations along each gate line at which the first and second gate lines portions are shorted to each other.

4. The display defined in claim 1 wherein the clock generator is configured to generate clock signals having clock pulses with fall times that vary between clock pulses.

5. The display defined in claim 1 further comprising a substrate, wherein the clock signal path includes metal traces formed from multiple different layers of metal on the substrate.

6. The display defined in claim 1 wherein the clock signal path includes horizontal clock signal lines each of which is coupled between the first clock line and a respective one of the gate driver circuits.

7. The display defined in claim 6 wherein the second clock line has metal traces formed from first and second metal layers and wherein the metal traces formed from the second metal layer overlap the first metal layer and have gaps through which the horizontal clock signal lines pass.

8. The display defined in claim 1 wherein the display comprises a liquid crystal display, wherein each of the pixels has a transistor and a storage capacitor coupled to the transistor, and wherein the gate driver circuitry includes at least some thin-film transistor circuitry.

9. The display defined in claim 1 wherein the display comprises a liquid crystal display, wherein each of the pixels has a transistor and a storage capacitor coupled to the transistor and wherein the gate driver circuitry includes at least some integrated circuits.

10. The display defined in claim 1, wherein each one of the plurality of tap point paths comprises a conductive trace that extends between the first clock line and the second clock line.

11. A display, comprising:

an array of pixels having rows and columns;

display driver circuitry that provides data signals to columns of the pixels over data lines, wherein the display driver circuitry includes gate driver circuitry that runs along at least one edge of the array of pixels and that has gate driver circuits that each provide a gate line signal to a respective row of the pixels over a respective gate line;

a clock generator configured to generate a clock signal having clock pulses with fall times that vary between clock pulses; and a clock path that conveys the clock signals to each of the gate driver circuits from the clock generator.

12. The display defined in claim 11 wherein each gate driver circuit receives a clock pulse characterized by the same fall time.

13. The display defined in claim 12 wherein each gate line has a first metal line and a second metal line and wherein the first and second metal lines are shorted to each other at a plurality of different locations along that gate line.

14. The display defined in claim 13 wherein the first and second metal lines of each gate line are shorted to each other at fewer than five different locations along that gate line.

15. The display defined in claim 14 further comprising a substrate, wherein at least a portion of the clock signal path includes metal traces formed from multiple different layers of metal on the substrate.

16. The display defined in claim 12 wherein the display comprises a liquid crystal display and wherein each of the pixels has a transistor and a storage capacitor coupled to the transistor.

17. A display, comprising:

an array of pixels having rows and columns;

data lines;

gate lines; and display driver circuitry that provides data signals to columns of the pixels over the data lines, wherein the display driver circuitry includes gate driver circuitry that runs along at least one edge of the array of pixels and that has gate driver circuits that each provide a gate line signal to a respective row of the pixels over a respective one of the gate lines, wherein each gate line has a first metal line and a second metal line, wherein the first and the second metal lines of that gate line run parallel to each other, and wherein the first and second metal lines of that gate line are shorted to each other at a plurality of different locations along that gate line.

18. The display defined in claim 17 wherein the first and second metal lines in each gate line are shorted to each other at fewer than five different locations along the gate line.

19. The display defined in claim 17 further comprising:

a clock generator configured to generate clock pulses with respective fall times that vary across the clock pulses; and a clock path that conveys the clock signals to each of the gate driver circuits from the clock generator.

20. The display defined in claim 17 further comprising:

a clock generator configured to generate clock pulses; and a clock path that provides the clock signals to each of the gate driver circuits from the clock generator, wherein the clock path has a first clock line that extends along the edge of the array of pixels, has a second clock line that extends along the edge of the array of pixels parallel to the first clock line, and has tap point paths each of which shorts the first clock line to the second clock line at a different respective location along the clock path to equalize fall times for the clock pulses where the clock pulses are received at the gate driver circuits.

* * * * *